US008528223B2

(12) United States Patent
Alisch et al.

(10) Patent No.: US 8,528,223 B2
(45) Date of Patent: Sep. 10, 2013

(54) LAUNDRY DEFLECTOR DEVICE FOR A HOUSEHOLD APPLIANCE FOR ATTENDING TO ITEMS OF LAUNDRY, AND SUCH A HOUSEHOLD APPLIANCE

(75) Inventors: Robert Alisch, Berlin (DE); Jaime Andia Laborda, Berlin (DE); Bernhard Heym, Berlin (DE); Rainer Jurmann, Falkensee (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 742 days.

(21) Appl. No.: 12/528,497

(22) PCT Filed: Jan. 16, 2008

(86) PCT No.: PCT/EP2008/050453

§ 371 (c)(1),
(2), (4) Date: Aug. 25, 2009

(87) PCT Pub. No.: WO2008/104420

PCT Pub. Date: Sep. 4, 2008

(65) Prior Publication Data

US 2010/0325911 A1 Dec. 30, 2010

(30) Foreign Application Priority Data

Feb. 27, 2007 (DE) ..... 10 2007 009 509

(51) Int. Cl.
*D06F 58/00* (2006.01)

(52) U.S. Cl.
USPC ..... 34/108; 68/23 A; 68/17 R; 34/601; 34/602

(58) Field of Classification Search
CPC ..... D06F 23/00; D06F 37/266; D06F 49/00; D06F 37/09; D06F 25/00
USPC ..... 34/108, 603, 604, 599, 601; 68/23.1, 68/139, 142
See application file for complete search history.

(56) References Cited

U.S. PATENT DOCUMENTS 3,908,412 A 9/1975 de Hedouville
5,371,956 A * 12/1994 St. Louis ..... 34/599

(Continued)

FOREIGN PATENT DOCUMENTS

DE 202004012221 U1 11/2004
EP 1321559 A1 6/2003

(Continued)

*Primary Examiner* — Kenneth Rinehart
*Assistant Examiner* — Jason Lau
(74) *Attorney, Agent, or Firm* — James E. Howard; Andre Pallapies

(57) ABSTRACT

A laundry deflector apparatus is provided for a household appliance for handling items of laundry and the laundry deflector apparatus includes a deflector element that is wedge-shaped and has a flat edge in the direction of a first end on the side opposite a base side and a steep edge in the direction of a second end opposite the first end, on the side opposite the base side. The laundry deflector apparatus is undercut in sections on the second end.

15 Claims, 2 Drawing Sheets

(56) References Cited

U.S. PATENT DOCUMENTS

| | | | | |
|---|---|---|---|---|
| 5,791,167 | A | 8/1998 | Wyatt et al. | |
| 6,497,121 | B1 | 12/2002 | Walsh et al. | |
| 6,698,107 | B2 * | 3/2004 | Song et al. | 34/595 |
| 7,013,683 | B1 | 3/2006 | Walsh et al. | |
| 2004/0088881 | A1 | 5/2004 | Buss et al. | |
| 2004/0187223 | A1 | 9/2004 | Clark | |
| 2007/0163144 | A1 * | 7/2007 | Dittmer et al. | 34/602 |
| 2007/0295037 | A1 * | 12/2007 | Blomberg et al. | 68/17 R |
| 2009/0165505 | A1 | 7/2009 | Bobed | |

FOREIGN PATENT DOCUMENTS

| | | | | |
|---|---|---|---|---|
| GB | 2114606 | A | * | 8/1983 |
| WO | 02/12612 | A1 | | 2/2002 |
| WO | WO2004104289 | | * | 12/2004 |
| WO | WO2006027149 | | * | 3/2006 |
| WO | 2008/104420 | A1 | | 9/2008 |

* cited by examiner

LAUNDRY DEFLECTOR DEVICE FOR A HOUSEHOLD APPLIANCE FOR ATTENDING TO ITEMS OF LAUNDRY, AND SUCH A HOUSEHOLD APPLIANCE

BACKGROUND OF THE INVENTION

The present invention relates to a laundry deflector apparatus for a domestic appliance for laundry care, in particular a washing machine or a tumble dryer, with at least one deflector element.

Such a laundry treatment device is known from DE 102 37 017 B3. With this laundry treatment device a laundry deflector is secured in the upper region of the opening of the outer tub, consisting of a rigid securing part and an elastic deflector part. The deflector part of the secured laundry deflector is inserted into the loading opening of the laundry drum forming a gap. The laundry deflector is intended to release laundry items which have become caught, in particular as the laundry drum accelerates into a spin, and project into the region of the seal and are held by the seal. One disadvantage of the known laundry deflector is that laundry can become trapped in the gap between the laundry deflector and the laundry drum and be damaged as a result. Also the friction forces acting between the laundry and the laundry deflector, in particular when the laundry drum is full, are so great that the deflector part is permanently abraded. The resulting abrasion has a detrimental effect on the laundry.

A seal for a washing machine with an integrated deflector part is also known from WO 02/12612 A1. The very elastic deflector part is stabilized by a metal wire inserted into the deflector part and bent. The metal wire is an integral component of the securing ring of the seal. Despite the stabilizing metal wire the laundry deflector is so unstable that the laundry deflector cannot release the laundry with sufficient reliability. The laundry deflector can also be damaged or even broken due to the friction of the laundry, in particular laundry with metal parts such as zippers and the like. The seal and ultimately also the laundry treatment device start to leak as a result.

A laundry treatment device with a laundry deflector is also known from DE 20 2004 012 221 U1. FIG. 1 shows a sectional diagram of a partial segment of this known washing machine. The outer tub 1 here is shown with an opening into which a laundry loading opening 3 of a laundry drum 2 projects. Only the so-called front sheet of the laundry drum 2 with the loading opening 3 is shown. The housing (not shown) has a door opening (filling in direction of arrow) corresponding to the loading opening 3 of the laundry drum 2 or the opening of the outer tub 1. The opening of the outer tub 1 is connected to a door opening by means of an elastic seal 5. The washing machine also has a laundry deflector 4, which is connected rigidly to the outer tub 1, close to the upper region of the opening and therefore also close to the upper region of the loading opening 3 of the laundry drum 2.

A further laundry deflector apparatus with an asymmetrical deflector element is also known from WO 2008/104420.

BRIEF SUMMARY OF THE INVENTION

The object of the present invention is to create a laundry deflector apparatus and a domestic appliance for laundry care, with which the laundry projecting in the region of the seal can be released effectively from the laundry drum without damaging the laundry and damage to the laundry items and the seal can be effectively prevented.

An inventive laundry deflector apparatus for a domestic appliance for laundry care, in particular a washing machine or tumble dryer, has a number of deflector elements. A deflector element is configured as wedge-shaped and configured in the direction of a first end of the deflector element on the face facing away from a base face of the deflector element with a flat edge pattern. In the direction of a second end, which is opposite the first end, a deflector element has a steep edge pattern on the face facing away from the base face and is configured as undercut at least in some regions at this second end. When viewed essentially laterally a deflector element is therefore configured with a significantly asymmetrical triangular shape, which on the one hand has a very flat, extended, rising edge pattern, which then changes to a very steeply dropping, relatively short edge pattern at the vertex. A deflector element is also configured at the second end in such a manner that the surface formed by the steep edge rise and the structural shape of the deflector element slopes to the rear at least in parts or is inclined to the rear, thereby producing the undercut.

This embodiment of the laundry deflector element allows a much better release of laundry items in the region of a seal between the outer tub and a housing wall of the domestic appliance. This shape of a deflector element can also ensure in effective further functionality that the laundry items are automatically directed back into the drum through the zone configured as undercut at the second end, if two such deflector elements are present in a suitable arrangement. When they strike this second end with the undercut, the laundry items experience an impetus in the direction of the interior of the drum.

This undercut is preferably configured over the entire edge face at the second end. Thus essentially the entire surface, which is configured over the entire edge rise at the second end, is configured with such an undercut and therefore is as it were inclined to the rear. This allows further improvement of the impetus to direct the released laundry items back into the drum.

The undercut is preferably configured in such a manner that when a deflector element is fitted on the domestic appliance, a front face of a deflector element facing the outer environment of the domestic appliance is configured longer at the second end than a rear face of a deflector element facing the interior of the domestic appliance. Thus when viewing the laundry deflector apparatus from the front only the longer front face of a deflector element is visible. The undercut region and thus the surface sloping to the rear at the second steep edge rise is virtually concealed by this front face. When viewed from the other side, the shorter rear face of the deflector element is visible and beyond this the sloping surface at this second end is also visible, this then representing the connection between the shorter rear face and the longer front face.

The shape of a deflector element at the first end is preferably configured as flat so that there is an essentially smooth transition into the shape of an element of the domestic appliance on which a deflector element is disposed. In particular the flat runout at the first end is shaped in such a manner and almost tapers to a point so that a completely smooth transition into a curved region of a seal of the domestic appliance is possible. This embodiment makes it possible to ensure that the laundry items projecting into the region of the seal can be carried along and released easily and reliably by the flat rise so that there is no abrupt pulling away, etc. This in turn allows damage to the laundry items during release to be prevented.

The shape of a deflector element at the second end is preferably configured so that there is an essentially smooth transition into the shape of an element of the domestic appliance on which a deflector element is disposed. It is true that in this respect provision is made for a relatively steep meeting between the edge and the element of the domestic appliance on which a deflector element is disposed but it is advantageous if a rounded and flowing transition is configured at the direct transition between the second end and the element of the domestic appliance, in particular in the seal.

A deflector element is preferably configured as a single piece. This allows simple and economical manufacture, for example as an injection molded part or the like.

The laundry deflector apparatus is preferably disposed on an elastic seal of the domestic appliance, which connects an opening of an outer tub to a door opening of the domestic appliance. In particular provision can be made for the laundry deflector apparatus to be configured as a single piece with the seal. This also allows the production process to be embodied in a simple and economical manner. Also such an embodiment allows the precise positioning of the laundry deflector apparatus on the seal to be defined and specified beforehand, thereby preventing incorrect positioning due to subsequent attachment and disproportionate tolerances to be avoided.

However provision can also be made for the laundry deflector apparatus to be attached to the seal later. Provision can be made here for example for adhesion or a thermal method to connect the materials of the laundry deflector apparatus and the seal permanently. Provision can be made for the laundry deflector apparatus to be made of plastic. This allows relatively complex shaping to be carried out simply and economically by injection molding. The plastic material is preferably selected so that the laundry deflector apparatus can be embodied in a rigid manner and there is no abrasion by the laundry. Problematic deposits on the laundry due to abrasion are thus advantageously avoided by such a plastic selection.

Provision can be made for the laundry deflector apparatus to be made of a non-stick plastic or to have a non-stick coating. Such an embodiment significantly reduces the friction between the laundry deflector and the washing to be released. This significantly reduces any damage to the laundry due to excessive friction when it is being released from the edge of the loading opening of the laundry drum. Plastics which have particularly good non-stick properties and at the same time are unaffected by laundry water are for example polyfluoroethylene (PTFE) or polyoxymethylene (POM).

The deflector element is preferably disposed on the seal in such a manner that the longitudinal axis of a deflector element is oriented in the circumferential direction of the seal. This means that a deflector element extends in a plane essentially parallel to the plane of the loading opening. This plane is essentially perpendicular to the axis of rotation of a laundry drum of the domestic appliance. This means that with corresponding rotation of the drum, particularly effective release of the laundry items in the region of the seal is enabled, as they as it were reach a deflector element, can be carried along on the flat edge and released.

The laundry deflector apparatus preferably comprises two deflector elements, which are configured in a corresponding manner and are disposed symmetrically in relation to an axis of symmetry of the seal of the domestic appliance. The two deflector elements are thus advantageously disposed in such a manner in relation to one another that the two second ends face one another. Such an embodiment is particularly advantageous, if the drum can generally be rotated in two directions. It can then be constantly ensured that the laundry is released by passing along the flat rise of a deflector element and as it were collides when it meets the edge rise of the second end with the undercut of the second deflector element, being given impetus there in the direction of the interior of the drum by the slope of this surface. The same can be achieved due to the symmetrical embodiment of the laundry alternator when rotating the drum in the opposite direction. It is thus always possible to allow the laundry items to be released reliably and a particular functionality is also enabled by the automatic axial acceleration of the laundry items back into the drum.

Provision can be made for the two laundry deflector elements of the laundry deflector apparatus to be configured as separate components and to be disposed at a distance from one another. The two deflector elements preferably extend in one plane, which is oriented parallel to the plane of the loading opening. The distance between the two deflector elements is preferably smaller than the length of a deflector element.

Provision can also be made for the two deflector elements to be connected to one another and to be configured virtually as a single piece. This allows simpler manufacture and the relative positioning of the deflector elements is also enabled more precisely. This allows a defined shape to be produced during manufacture and in particular during injection molding, ensuring the precise shaping and positioning of the elements in relation to one another. This can also allow faster and simpler assembly.

It is particularly advantageous if such a single-piece configuration of the at least two deflector elements of the laundry deflector apparatus is also configured as a single piece with the seal.

The laundry deflector element, in particular at least one deflector element, is preferably disposed on a surface facing the axis of rotation of the seal or a web facing this axis.

A further aspect of the invention relates to a domestic appliance for laundry care, with a laundry drum supported in a rotatable manner in a tub, said tub having an opening and the laundry drum having a loading opening for laundry corresponding to said opening. The domestic appliance also has a housing, which has a door opening corresponding to the opening or the loading opening. The domestic appliance also has an elastic seal, which connects the opening of the tub to the door opening. A laundry deflector apparatus according to the invention or an advantageous embodiment thereof is disposed on the seal, being positioned in an upper region of the opening of the tub. With such a domestic appliance, in particular a washing machine or a tumble dryer, it is possible to enable an effective release of laundry items projecting into the region of the seal, which damages neither the laundry nor the seal, in particular during the spin process. It can also be ensured that these released laundry items are conducted back into the interior of the drum.

BRIEF DESCRIPTION OF THE DRAWINGS

Exemplary embodiments of the invention are described in more detail below with reference to schematic drawings, in which.

DETAILED DESCRIPTION OF EXEMPLARY EMBODIMENTS OF THE PRESENT INVENTION

Figure 1:
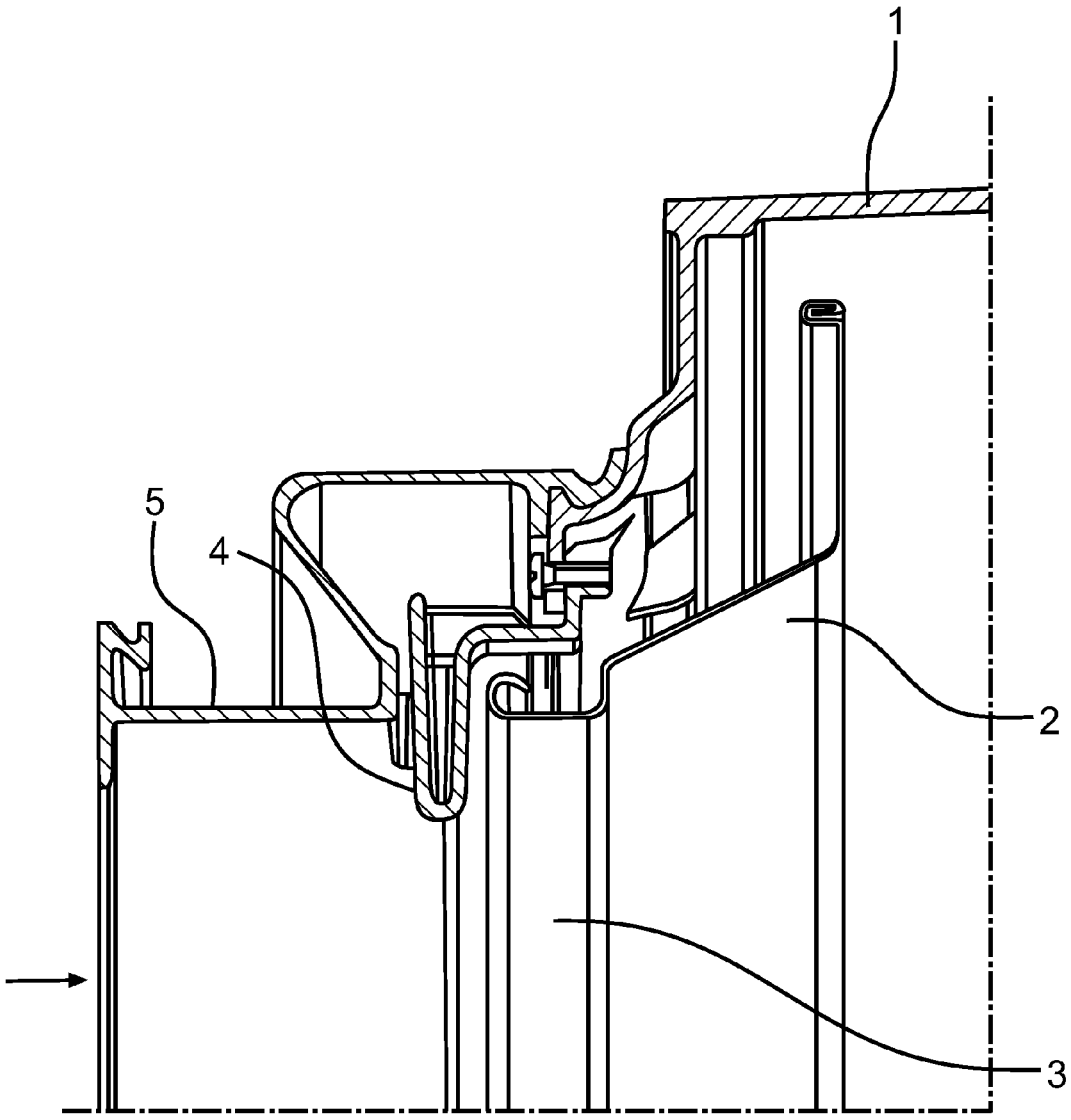
Fig.1 (Prior art)
FIG. 1 shows a schematic sectional diagram of a domestic appliance with a laundry deflector element known from the prior art.

Identical elements or elements with identical function are shown with the same reference characters in all the figures.

In the exemplary embodiment an inventive domestic appliance for laundry care is configured as a washing machine and comprises an outer tub, a laundry drum and a loading opening, as also shown and disposed in the diagram according to FIG. 1. The arrow representation in FIG. 1 indicates the introduction of laundry items into the interior of the laundry drum through the door opening in respect of the arrangement of the above-mentioned components.

The washing machine also comprises a seal 5', which is disposed between the outer tub and a housing wall and connects the opening of the outer tub to the door opening of the washing machine.

During operation of the washing machine laundry can pass from the laundry drum 2 into the region encompassed by the seal 5' due to the movement of the laundry drum. In particular if the laundry drum 2 is loaded with a large quantity of laundry, the movement of the laundry drum 2 can cause individual laundry items to pass over the edge of the loading opening 3 into the region encompassed by the seal 5'. The seal 5' is essentially disposed in a region of the washing machine, as shown in the arrangement of the seal 5 in the prior art according to FIG. 1.

These laundry items then still rest to some degree on the wall of the laundry drum 2 and are thus carried with the rotating laundry drum 2.

Figure 2:
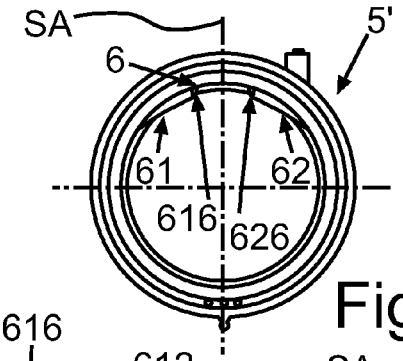
FIG. 2 shows a schematic rear view of a seal for a domestic appliance for laundry care with an inventive laundry deflector apparatus.

FIG. 2 shows a rear view of the seal 5', which is configured from an elastic material. Rear view here describes a viewing direction from the interior of the laundry drum 2 in an outward direction. It can be seen from the schematic diagram according to FIG. 2 that a laundry deflector apparatus 6 with two deflector elements 61 and 62 is disposed on the seal 5'. The laundry deflector apparatus 6 is disposed in an upper region of the seal 5' and is disposed symmetrically in relation to a vertical axis of symmetry SA of the seal 5'. In the exemplary embodiment the laundry deflector apparatus 6 is configured as a single piece with the seal 5'. The deflector elements 61 and 62 are configured with essentially the same shape and dimensions and are disposed at a distance from one another.

The more precise embodiment of the laundry deflector apparatus 6 is described in more detail below with reference to FIG. 3. This shows an enlarged partial segment of the diagram in FIG. 2. The first deflector element 61 is configured as wedge-shaped and has a first end 611 and a second end 612. The laundry deflector apparatus 6 and therefore also the deflector elements 61 and 62 are configured on the seal 5' in such a manner that they extend virtually in one plane, which extends parallel to the plane of the loading opening 3.

The deflector element 61 which is also described in more detail for the similarly configured deflector element 62, has an as it were significantly asymmetrical triangular profile due to its wedge shape. The deflector element 61 has an assembly face or base face 613, with which it is disposed directly on a web 51. The web 51 represents as it were a surface, which faces an axis of symmetry of the seal 5' oriented perpendicular to the plane of the figure. On the opposite side of this base face 613 the deflector element 61 has a relatively flat edge pattern 614 starting from the first end 611. This relatively flat rising edge pattern 614 extends over a substantial length of the deflector element 61 and then changes to a relatively steeply dropping edge pattern 615 at the second end 612. At the second end 612 the deflector element 61 also has an undercut 616. As shown in the diagram in FIG. 3, in the exemplary embodiment this undercut 616 is configured essentially over the entire surface formed by the steep edge pattern 615. The surface at this end 612 in the region of the edge pattern 615 is therefore inclined as it were to the rear. In the view shown in FIG. 3 (view from the rear of the seal 5' outward and thus from the interior of the laundry drum 2 outward) this means that the undercut 616 or the surface formed by the edge pattern 615 can be seen and when viewed toward the outside slopes as it were forward and runs toward the axis SA.

Figure 4:
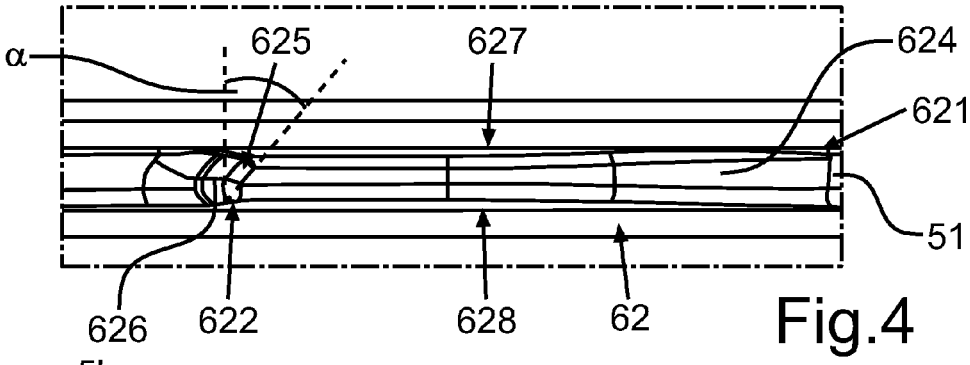
FIG. 4 shows a schematic diagram of a view of a laundry deflector apparatus according to FIG. 3, viewing the axis of rotation radially from the outside.

A cutout tapering outward in the viewing direction in FIG. 4 is configured on the facing two ends 612 and 622 (FIG. 4) and the respectively configured undercuts 616 and 626 in conjunction with the second deflector element 62.

Figure 3:
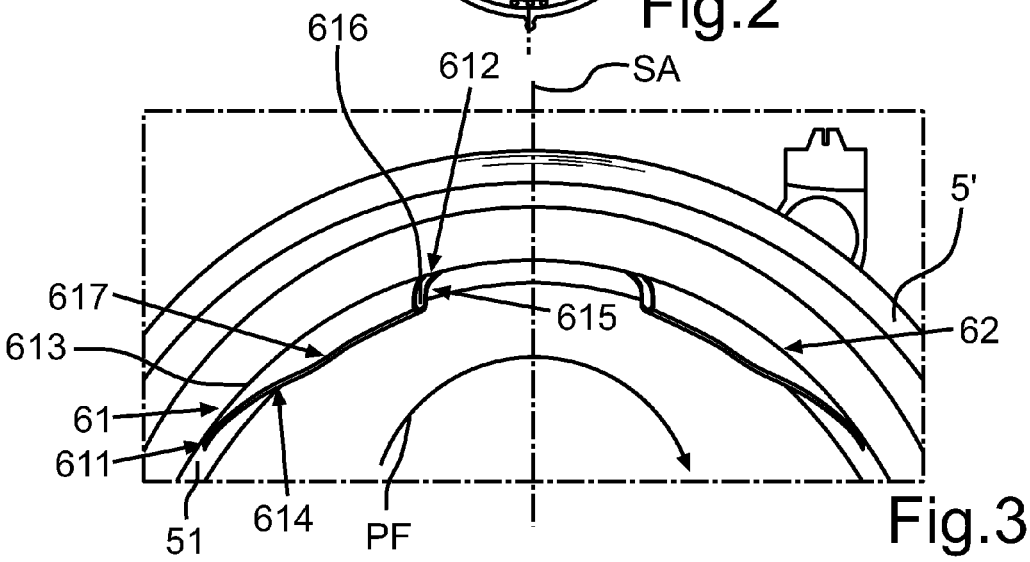
FIG. 3 shows an enlarged diagram of a partial segment according to FIG. 2.
Figure 5:
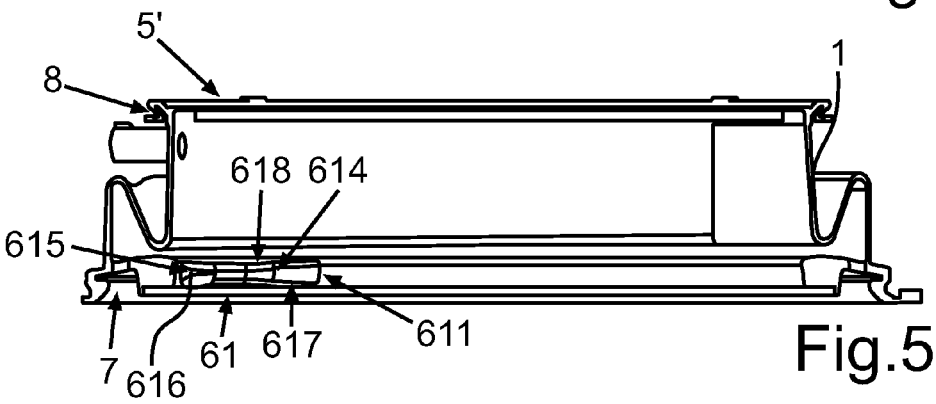
FIG. 5 shows a further diagram in the viewing direction in FIG. 4.

According to the diagram in FIG. 3 this slope of the undercut 616 is achieved in that a rear face 617 of the deflector element 61 is configured shorter at the second end 612 in the longitudinal direction of the deflector element 61 than a front face 618 (FIG. 5). The rear face 617 here represents the face facing the interior of the laundry drum 2, while the front face 618 represents the outer face facing the outer environment of the domestic appliance.

It can also be seen from the diagram according to FIG. 3 that the deflector element 61 tapers almost to a point at the first end 611 and the very flat runout is configured in such a manner that a continuous and smooth transition into the shape or curvature of the seal 5' and in particular of the web 51 is ensured. At the second end 612 the relatively steep edge pattern 615 is also configured as somewhat flatter at the direct transition to the web 51, so that a smooth transition into the web 51 can be ensured here too.

In the embodiment shown the two deflector elements 61 and 62 are disposed as separate parts. Provision can also be made for the two deflector elements 61 and 62 to be configured as a single piece and be disposed on the seal 5'.

In the exemplary embodiment the distance between the two deflector elements 61 and 62 is less than the length of one deflector element 61 or 62.

Both deflector elements 61 and 62 have a relatively flat angle of entry, which is configured respectively at the first ends 611 and/or 621 (FIG. 4). Depending on the rotation direction of the laundry drum 2, which can be rotated to both sides about the axis of rotation, the very flat angle of entry due to the shape of a deflector element allows much better release of the corresponding laundry items and the friction between the laundry items and the material of the seal 5' and the corresponding deflector element 61 and/or 62 is minimized.

The facing second ends 612 and/or 622 of the deflector elements 61 and/or 62 are configured with the undercuts 616 and/or 626 and therefore have a surface region which has an inwardly oriented setting angle. This causes the released laundry items to be conducted back into the interior of the laundry drum 2.

If for example the laundry drum 2 rotates in the direction PF in the partial segment shown in FIG. 3, the laundry items projecting into the region of the seal 5' are released by the flat angle of entry at the first end 611 of the deflector element 61 and conducted in the direction of the second deflector element 62. As soon as these laundry items leave the first deflector element 61, they are subjected by the setting angle and/or undercut 626 of the second deflector element 62 on impact to an impetus in the direction of the interior of the laundry drum 2. This impetus is sufficient for the laundry items to be spun back into the interior of the laundry drum 2 with the aid of the relatively high rotation speed of the laundry drum 2.

The functionality is correspondingly reversed, when the drum rotates counter to the direction PF.

In particular during a first operating phase of the washing machine, in which the dry laundry absorbs water or washing liquor, the dry or not yet completely wet laundry has a larger volume that than the completely wet laundry and is therefore more likely to pass into the region encompassed by the seal 5' during such operating phases. In this operating phase the laundry drum 2 is generally rotated in a reversing manner. It is therefore particularly advantageous if the laundry deflector apparatus 6 is configured in a symmetrical manner as shown in FIG. 3. This means that the action of release and providing impetus for spinning back into the interior of the drum is identical for both directions of rotation of the laundry drum 2.

Alternatively the profile of the laundry deflector apparatus 6 can also be configured as asymmetrical, if it is ensured that the operating phase in which the laundry deflector apparatus 6 is to be predominantly active, is characterized by a rotation of the laundry drum 2 in a single direction.

FIG. 4 shows a view of a partial segment of the diagram in FIG. 3, showing a plan view of the deflector element 62. The view is directed radially outward from the axis of symmetry of the seal 5' perpendicular to the plane of the figure in the direction of the deflector element 62. It can be seen that a deflector element 62 has essentially the width of the web 51. The relatively flat rise of the edge pattern 624 from the first end 621 can also be seen. The relatively steep drop of the edge pattern 625 at the second end 622 can also be seen. The deflector element 62, which is described and shown in FIG. 4 for the deflector element 61 as well, is configured as essentially completely rectilinear in the diagram shown.

In the diagram according to FIG. 4 the undercut 626 can also be seen, sloping at an angle $\alpha$ to the non-sloping reference plane. It can be seen that the rear face 627 is configured shorter in the region of the second end 622 than the front face 628.

FIG. 5 shows a perspective diagram of a further partial segment from the seal 5'. This is also a view in a radial viewing direction outward as in the diagram in FIG. 4. This diagram shows the deflector element 61. The engagement regions 7 for the outer tub 1 and the engagement regions 8 for the door opening and/or the housing wall of the washing machine on the seal 5' are shown by way of example.

The laundry deflector apparatus 6 is made of PTFE for example. This material is both highly resistant to laundry water and also stable enough for the required strength of the laundry deflector apparatus 6. Material erosion due laundry rubbing against the deflector elements 61 and/or 62, in particular laundry having metal components such as zippers and the like, is avoided with a material of the selected type. This plastic also has a very good non-stick capability, thereby reducing friction as the laundry passes the laundry deflector apparatus 6. This protects the laundry during release.

Alternatively a POM material or another non-stick plastic can also be used to make the laundry deflector apparatus 6. However provision can also be made for the laundry deflector apparatus 6 to have a non-stick coating.

The invention claimed is:

1. A laundry deflector apparatus for a domestic laundry appliance, the laundry deflector apparatus comprising:

a plurality of deflector elements, at least one of the deflector elements having a base face and a pair of side faces each joined to the base face, the base face of the at least one deflector element having a first end defining a generally flat angle of entry and a second end, the pair of side faces including a front side face and a rear side face wherein the front side face is configured longer than the rear side face at the second end thereby forming an undercut at the second end wherein the undercut slopes at a predetermined angle with respect to the base face thereby defining an inwardly-oriented setting angle to direct released laundry items toward an interior of a laundry drum.

2. The laundry deflector apparatus as claimed in claim 1, and further comprising an edge face facing away from the base face, wherein the undercut extends along the entire extent of another respective portion of the edge face in the vicinity of the second end of the base face.

3. The laundry deflector apparatus as claimed in claim 1, wherein, in an installed disposition of the laundry deflector apparatus on a domestic laundry appliance wherein the front side face of the at least one deflector element faces the outer environment of the domestic laundry appliance as a front side face and the rear side face of the at least one deflector element faces the interior of the domestic laundry appliance.

4. The laundry deflector apparatus as claimed in claim 1, and further comprising an edge face facing away from the base face, wherein the respective portion of the edge face in the vicinity of the first end of the base face extends increasingly outwardly from the base face in the direction from a start that is flat with the domestic appliance on which the at least one deflector element is disposed such that there is a smooth transition from the domestic laundry appliance on which the at least one deflector element is disposed into the shape of the at least one deflector element.

5. The laundry deflector apparatus as claimed in claim 1, wherein the shape of the second end of a deflector element is configured such that there is a smooth transition from the domestic laundry appliance on which the at least one deflector element is disposed into the shape of the at least one deflector element.

6. The laundry deflector apparatus as claimed in claim 1, wherein the at least one deflector element is configured as a single piece.

7. The laundry deflector apparatus as claimed in claim 1, wherein the at least one deflector element is disposed on an elastic seal of the domestic appliance, the seal connecting an opening of an outer tub of the domestic appliance to a door opening of the domestic laundry appliance.

8. The laundry deflector apparatus as claimed in claim 7, wherein the laundry deflector apparatus is configured as a single piece with the seal.

9. The laundry deflector apparatus as claimed in claim 7, wherein the at least one deflector element is disposed on the seal in such a manner that it is disposed in a plane parallel to a plane of a loading opening of the domestic laundry appliance.

10. The laundry deflector apparatus as claimed in claim 1, wherein another one of the deflector elements is configured in a corresponding manner with the at least one deflector element and these two deflector elements are disposed symmetrically in relation to an axis of symmetry of the seal of the domestic laundry appliance, wherein a second end of the correspondingly configured second deflector element faces a second end of a first deflector element.

11. The laundry deflector apparatus as claimed in claim 10, wherein the two deflector elements are configured as separate components and are disposed at a distance from one another.

12. The laundry deflector apparatus as claimed in claim 10, wherein the two deflector elements are connected to one another and are configured as a single piece.

13. A domestic laundry appliance comprising:

a tub having an opening;

a laundry drum supported in a rotatable manner in the tub, the laundry drum having a loading opening for loading laundry into and out of the laundry drum and the loading opening being operatively aligned with the tub opening;

a housing, the housing having a door opening operatively aligned with the loading opening of the laundry drum and having an elastic seal that connects the tub opening and the door opening; and a laundry deflector apparatus disposed on the seal and positioned in an upper region of the tub opening, the laundry deflector apparatus including a plurality of deflector elements, at least one of the deflector elements having a base face and a pair of side faces each joined to the base face, the base face of the at least one deflector element having a first end and a second end, the pair of side faces including a front side face facing the outer environment of the domestic laundry appliance and a rear side face facing an interior of the domestic laundry appliance wherein the front side face is configured longer than the rear side face at the second end thereby forming an undercut at the second end.

14. A laundry deflector apparatus for a domestic laundry appliance, the laundry deflector apparatus comprising:

a plurality of deflector elements, at least one of the deflector elements having a base face and a pair of side faces each joined to the base face, the pair of side faces delimiting two sides of a triangle, the base face delimiting the third side of the triangle, the pair of side faces being joined to one another along an edge face facing away from the base face, the base face of the at least one deflector element having a first end and a second end, and the at least one deflector element having an edge pattern along the edge face in which a respective portion of the edge face in the vicinity of the first end of the base face extends increasingly outwardly from the base face in a direction from the first end of the base face toward the second end of the base face at a first slope and in which another respective portion of the edge face in the vicinity of the second end of the base face extends increasingly outwardly from the base face at a second slope, wherein the second slope is steeper than the first slope, and at least a portion of the second end of the base face has an undercut extending along the entire another respective portion of the edge face in the vicinity of the second end of the base face wherein, in an installed disposition of the laundry deflector apparatus on a domestic laundry appliance in which the laundry deflector apparatus one of the side faces of the at least one deflector element faces the outer environment of the domestic laundry appliance as a front side face and the other side face of the at least one deflector element faces the interior of the domestic laundry appliance as a rear side face, the front side face and the rear side face each delimit a border of the undercut at the second end of the base face, and the front side face extends relatively longer than the rear side face at the second end of the base face.

15. A laundry deflector apparatus according to claim 14 and wherein the plurality of deflector elements includes at least a first deflector element and a second deflector element with the second deflector element configured to correspond with the first deflector element and a second end of the correspondingly configured second deflector element faces the second end of the first deflector element.

* * * * *

UNITED STATES PATENT AND TRADEMARK OFFICE

CERTIFICATE OF CORRECTION

PATENT NO. : 8,528,223 B2
APPLICATION NO. : 12/528497
DATED : September 10, 2013
INVENTOR(S) : Alisch et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 819 days.

Signed and Sealed this
Fifteenth Day of September, 2015

Michelle K. Lee

Michelle K. Lee
*Director of the United States Patent and Trademark Office*